United States Patent [19]

Kaufman

[11] 3,987,694

[45] Oct. 26, 1976

[54] CLAMP BAR AND ADJUSTABLE STOP FOR CUTTING BOARD

[76] Inventor: William Kaufman, 4 Stonehurst Court, Pomona, N.Y. 10970

[22] Filed: Feb. 6, 1975

[21] Appl. No.: 547,645

[52] U.S. Cl. ..... 83/453; 83/459; 83/464; 83/466; 83/607

[51] Int. Cl.[2] ..... B26D 5/10; B26D 7/04

[58] Field of Search ..... 83/453, 464, 459, 466, 83/465, 607, 608, 609

[56] References Cited

UNITED STATES PATENTS

| | | | |
|---|---|---|---|
| 18,065 | 8/1957 | Toulmin | 83/608 |
| 811,940 | 2/1906 | Marston et al. | 83/607 X |
| 884,219 | 4/1908 | Scates | 83/459 |
| 1,167,435 | 1/1916 | Robertson et al. | 83/520 |
| 1,612,956 | 1/1927 | Valiquette et al. | 83/465 |
| 1,730,718 | 10/1929 | Bosch, Jr. | 83/607 X |
| 2,327,223 | 8/1943 | Silver | 83/459 |
| 2,353,590 | 7/1944 | Schutz | 83/464 X |
| 3,532,018 | 10/1970 | Szabo | 83/520 X |

*Primary Examiner*—J. M. Meister

[57] ABSTRACT

In a cutting board assembly having a clamp bar operated by a foot pedal mechanism for clamping papers or similar materials to the board for cutting, means are provided for accurately aligning guide markings on the paper with the cutting edge of the board. Such means include an aligning strip secured to the under surface of the clamp bar and projecting therefrom, with the straight edge of the projecting portion of the strip registering with the cutting edge of the board, whereby the markings on the paper can be visually aligned with the straight edge of the strip and therefore with the cutting edge of the board for accurate cutting. The aligning strip may be made of transparent material or of opaque material provided with apertures through which the markings can be seen. The foot pedal mechanism is also provided with adjustable stop means which limits upward travel of the clamp bar so that the aligning strip is maintained close to the paper to be cut for accurate alignment of the markings thereon.

7 Claims, 5 Drawing Figures

CLAMP BAR AND ADJUSTABLE STOP FOR CUTTING BOARD

The present invention relates in general to cutting board assemblies and more particularly to a clamp bar and an adjustable stop for a cutting board.

Conventional heavy-duty cutting board mechanisms for the cutting of quantities of paper sheets, such as paper pattern markers for the garment and allied industries, include a flat board or table top on which a knife is pivotally mounted and is hand operated to shear the paper sheets against an edge of the board. The mechanism also includes a clamp devise having a clamp bar which is operated by a foot pedal, and which bears against the paper sheets to prevent relative motion of the paper sheets when they are cut. The disadvantages of conventional cutting boards of this type become evident when they are used in the cutting of pattern marker sheets which must be cut quickly and with precision for economy and accuracy of production. The lines on which pattern markers are to be cut are usually indicated by rows of dots. The alignment of these rows of dots with the edge of the conventional cutting board is difficult since the cutting board edge is covered by the material to be cut, eliminating the edge as a possible visible reference, and the clamp bar covers the rows of dots when it is lowered into place. This leads to unwanted trial and error steps in the placement of the material to be cut on the cutting table and potential errors in cutting with consequent waste of material.

The present invention overcomes the deficiencies of the prior art by providing a clamp bar having a transparent portion which bears against the material to be cut and enables the operator to accurately align the material to be cut with shearing edge of the board. In a second embodiment of the invention, the clamp bar is made of a perforated material and the perforations aid in the accurate alignment of the material to be cut.

Another disadvantage of conventional cutting boards is related to the foot pedal mechanism which operates the clamp bar. Conventional foot pedal mechanisms permit the clamp bar to lift to a relatively great height above the surface of the board top. This results in inaccuracy in the initial placement of material to be cut on the cutting board since the operator has to estimate the location of the lowered position of the clamp bar. This leads, as before, to time consuming trial and error steps in the placement of the material to be cut.

The present invention overcomes the disadvantages of the prior art by providing an adjustable stop for the foot pedal mechanism which limits the upward travel of the clamp bar to a predetermined optimum height above the material to be cut. The adjustable stop according to the present invention is mounted on a leg supporting the cutting board and can be adjusted to accomodate various thicknesses of material to be cut.

It is an object of the present invention to provide a cutting board clamp bar having a transparent portion permitting the accurate alignment of material to be cut on the cutting table.

Another object of the present invention is to provide a cutting board clamp bar having perforated portion for use in the alignment of material to be cut on the cutting table.

Another object of the present invention is to provide an adjustable stop for a foot operated cutting board clamp bar mechanism to limit the upward travel of the clamp bar.

Still another object of the present invention is to provide a cutting board clamp bar and an adjustable stop which are economical of manufacture and which can easily be incorporated on conventional cutting board assemblies.

Additional objects and advantages of the invention will become apparent during the course of the following specification when taken in connection with the accompanying drawing in which.

Figure 1:
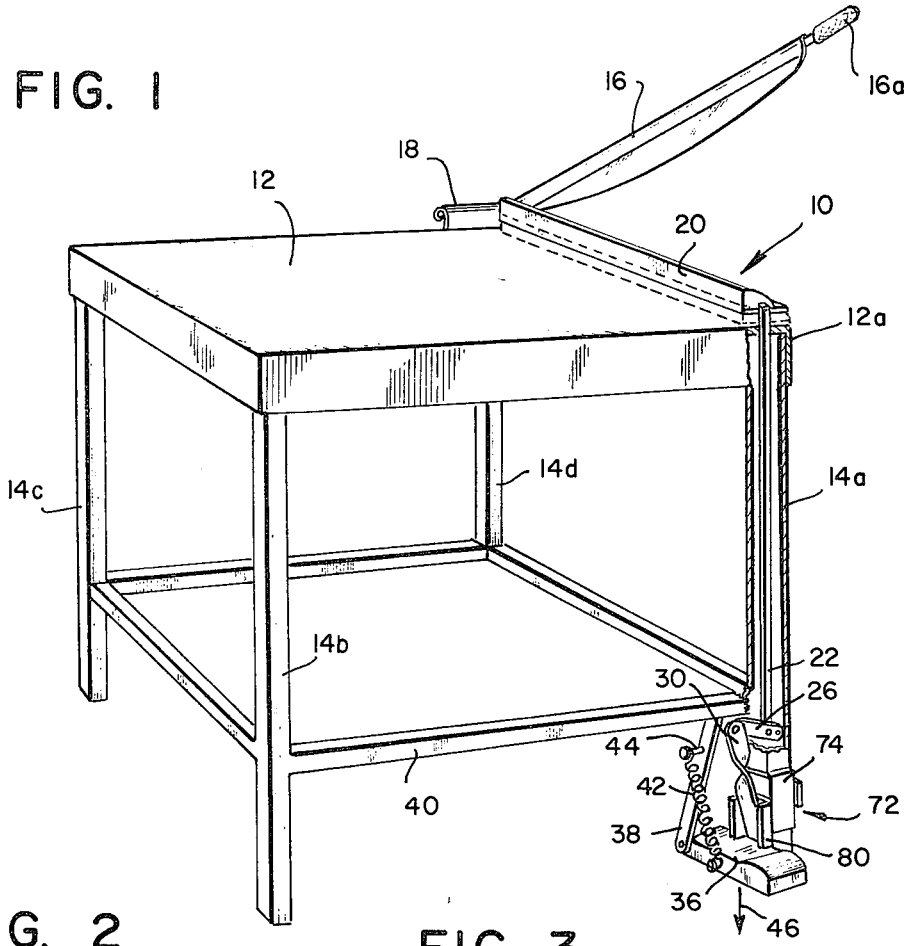
FIG. 1 is a perspective view of the cutting board assembly incorporating a clamp bar according to the present invention.

Referring in detail to the drawings, there is shown in FIG. 1 a cutting board assembly 10 which includes the novel clamp bar features of the present invention. The structure of the cutting board device itself is conventional and well-known, comprising a horizontally-disposed board or table 12 mounted on legs 14*a*, 14*b*, 14*c* and 14*d* in the form of hollow channel irons. One edge 12*a* of the board or table 12 is the edge along which paper sheets are cut, and adjacent this edge 12*a* and elongated knife 16 is mounted by pivot means 18. The knife 16 is mounted parallel to the edge 12*a* and closely spaced from said edge when in its lowered position. In use, the knife 16 is pivoted upwardly to the elevated position shown in FIG. 1, and sheets of paper or similar materials are laid flat upon the surface of the board or table 12, with a portion of the sheets overlapping the cutting edge 12*a*. The knife 16 is then grasped by its handle 16*a* and pivoted downwardly to cut the sheets along edge 12*a* in a shearing action.

Figure 4:
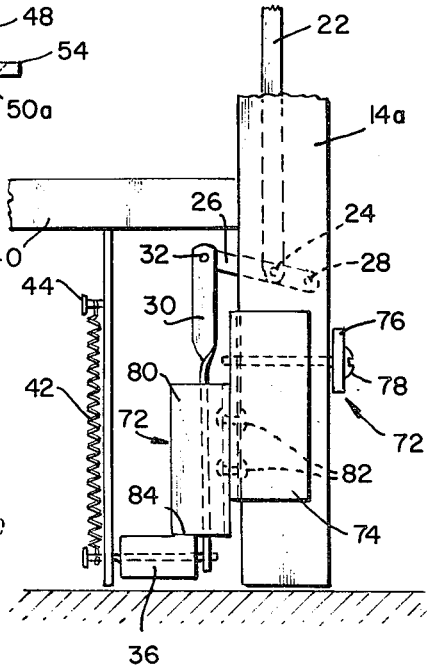
FIG. 4 is a fragmentary elevation view of the front leg of the cutting board of FIG. 1 showing a mounted adjustable stop, according to the present invention; and, FIG. 5 is a plan view of a second embodiment of the clamp bar according to the present invention.

The table assembly also includes clamping means which clamps the upper sheets tightly an immovably against the upper surface of the board or table 12 while the knife 16 is being manually lowered in the cutting operation, thereby preventing the paper from slipping and insuring accuracy of the cut. The clamping means includes a clamp bar 20 mounted on the upper end of a pull rod 22 which extends downwardly through the hollow interior of one of the front legs 14*a*. The lower end of the pull rod 22 is connected by pivot pin 24 to an intermediate portion of a lever 26, as shown in FIG. 4. One end of lever 26 is connected by pivot pin 28 to the front leg 14*a*, while the other end thereof is connected by pivot pin 32 to a foot pedal rod 30. The foot pedal rod 30 is connected to an intermediate portion of a foot pedal 36 which is pivotally mounted on a bracket 38 which projects downwardly from a cross-bar 40.

The foot pedal 36 is biased in an upward direction by a helical tension spring 42, one end of which is attached to the foot pedal 36, and the other end of which is connected to a pin 44 affixed to the pedal bracket 38. Downward pressure on the foot pedal 36, in the direction shown by arrow 46 in FIG. 1, causes corresponding downward travel of the clamp bar 10.

The cutting board structure described above is conventional. In use of such assembly, a paper sheet or stack of sheets is laid flat upon the top surface of the board 12 for cutting. The uppermost sheet in the stack is marked to indicate the straight line along which the cut is to be made, and these markings must be set accurately in registry with the cutting edge 12*a* of the board 12. If the marking is made by a straight line running from one edge of the paper sheet to the other, it is an easy matter to set the ends of the line at the edges of the paper in registry with the cutting edge. However, in many instances, the markings do not extend to the edge of the paper sheet. For example, in prepared pattern marking sheets, the markings are made by a series of spaced dots either perforated in the paper or drawn thereon, which dots are located in intermediate portions of the paper and do not extend to the edge thereof. Thus, when the paper is set down on the cutting board, the paper itself covers over and masks the cutting edge 12*a* of the board 12, and it is impossible to accurately align the series of markings with the cutting edge. The clamp bar 20 cannot aid in the alignment of the paper with the cutting edge, since its forward edge is located an appreciable distance rearwardly of the cutting edge.

The novel structure about to be described is incorporated in the cutting board assembly for the purpose of enabling the straight line markings on the sheet to be cut to be accurately aligned and set in registry with the cutting edge of the board.

Figure 2:
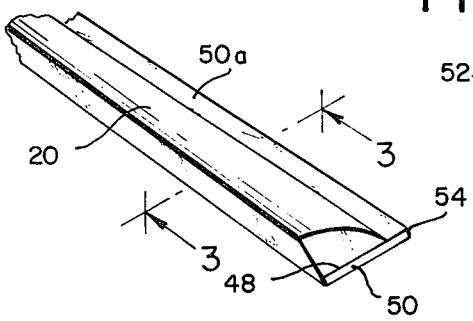
FIG. 2 is a fragmentary perspective view of a first embodiment of the clamp bar according to the present invention.
Figure 3:
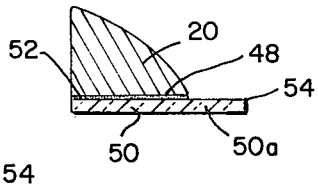
FIG. 3 is a cross-sectional view taken along the line 3—3 of FIG. 2.

The clamp bar 20 extends across the width of the table or board 12 and is of generally triangular cross-section, as shown in FIGS. 2 and 3, having a flat bottom surface 48, which in conventional operation, engages the uppermost paper sheet placed on the board. To this bottom surface there is affixed, as by an adhesive layer 52, an aligning strip 50. The strip 50 is of rectangular shape and extends the entire length of the clamp bar 20. The strip 50 is, however, of greater width than the clamp bar 20 and has a portion 50*a* which projects forwardly from the clamp bar. This projecting portion 50*a* has a straight front edge 54 which is parallel to the front edge of the clamp bar 20.

The aligning strip 50 is made of transparent material, preferably plastic, which is sufficiently sturdy and rigid to provide adequate downwardly clamping force upon the material to be cut when the clamp bar 20 is operated. The strip 50 is of such dimension and is so mounted that its straight front edge 54 is in exact registry with the cutting edge 12*a* of the board 12. Since the clamp bar 20 is raised and lowered in a precise vertical direction by the pull rod 22, the front edge 54 of strip 50 is always parallel to and aligned with the cutting edge 12*a* of the board 12, regardless of the position of the clamp bar.

In use, a sheet of paper or a superimposed stack of papers are placed on the upper surface of the cutting board 12 beneath the clamp bar 20 which is in raised position. The papers are slid forwardly on the board 12 until the line of markings thereon are in approximate alignment with the cutting edge 12*a* of the board. Since the ends of the papers now overlap the cutting edge 12*a*, this cutting edge is not visible to the user and cannot be used as a reference for aligning the markings therewith. However, the user can now align the markings exactly with the straight front edge 54 of the aligning strip 50 which is carried by the elevated clamp bar 20. When the clamp bar 20 is lowered, the strip 50 is brought into pressing engagement with the paper on the board, and the user may make a final visual check to insure that the line of markings is exactly aligned with the front edge 54 of aligning strip 50, and thus also with the cutting edge 12*a* of the board 12. When the knife 16 is now lowered, the paper will be cut accurately along its markings.

Because the aligning strip 50 is transparent the user is able to see the markings therethrough as the paper is pushed forwardly thereunder toward the cutting edge of the board. The user may thus visually follow the progress of the markings and determine when they are coming into alignment with the front ege 54 of strip 50, thus aligning the markings quickly and easily.

Figure 5:
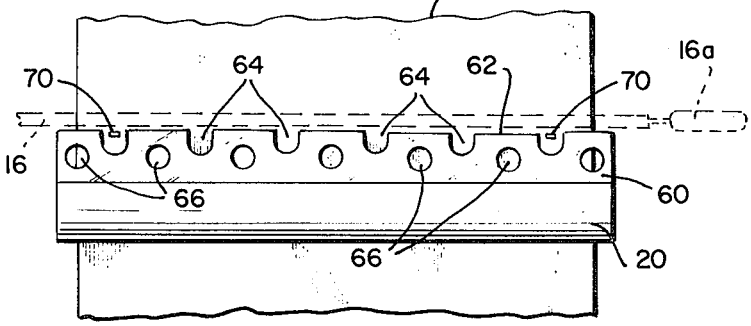

FIG. 5 shows an alternative embodiment of the invention in which an aligning strip is again secured to the bottom surface of the clamp bar 20. In this embodiment, the aligning strip 60 is made of an opaque material such as metal, and, as in the previous embodiment, has a straight front edge 62 which is positioned in registry with the cutting edge 12*a* of the board 12. The strip 60 is provided with a row of spaced U-shaped notches 64 along the front edge 62, and with a row of circular holes or apertures 66 located behind the notches 64 and spaced in staggered relationship therewith. As shown in FIG. 5, the front edge 62 of strip 60 is parallel to and in close proximity to the knife 16 (shown in broken line), when the latter is in lowered position for cutting.

FIG. 5 shows a sheet of pattern tracing paper 68 as it would be positioned on the board 12 beneath the clamp bar 20 for cutting. The paper 68 has a line of markings 70 thereon, along which a cut is to be made. As the paper is slid forwardly along the board 12 beneath the clamp bar 20 and its attached strip 60, in a direction in which the markings 70 approach the cutting edge 12*a* of the board, the user can view the movement of the markings, through the holes 66 and the U-shaped notches 64, and in this manner ascertain exactly when the markings 70 come into registry with the front edge 62 of aligning strip 60. In FIG. 5, the markings 70 are shown in such alignment with the strip front edge 62, the aligned positions being visible through the notches 70.

FIG. 4 shows an adjustable stop means 72 made in accordance with the present invention for the purpose of limiting the upward movement of the clamp bar 20 its retracted position. If the clamp bar is raised to too great a distance above the paper on the board 12, it becomes difficult or even impossible to align the paper markings accurately with the front edge of the aligning strip. The stop means 72 enables the raised, retracted position of the clamp member to be adjusted and set so that the elevated clamp bar is only a short distance above the paper.

The stop means 72 includes a first U-shaped channel member 74, which may be a short length of channel iron, which fits around the front leg 14*a* of the cutting board and is adjustably secured thereto by a bar 76 which is clamped against leg 14*a* by one or more screws 78. The channel member 74 is connected to a second U-shaped channel member 80 by rivets 82 or similar attachment means. As shown in FIG. 4, the second channel member 80 is laterally offset from the first channel member 74 and has a bottom edge 84 which overlies a portion of the top surface of foot pedal 36.

When set in selected position, the adjustable stop means 12 limits the upward travel of the foot pedal 36 and consequently the upward travel of the clamp bar 20. When the foot pedal 36 is released, the spring 42 urges it upwardly causing the pull rod 22 to elevate the clamp bar accordingly. The upward movement of the foot pedal 36 continues until it engages and is stopped by the lower edge 84 of the overlying channel member 80. The elevated position of the clamp bar 20 can be selectively adjusted by loosening the screws 78 to release the clamping force on bar 76, and raising or lowering the channel member 74 and its attached channel member 80 relative to the foot pedal 36. Thus, if there is a single sheet of paper on board 12 or a thick stack of paper sheets, the elevated position of the clamp bar can be so set that the adjusting strip 50 or 60 is closely spaced above the uppermost sheet, and an accurate alignment of the markings on the sheet can be made. The limited upward travel of the clamp bar 20 combined with the transparent nature of the adjusting strip greatly facilitates the rapid and accurate placement of materials to be cut on the board 12.

While preferred embodiments of the invention have been shown and described herein, it is obvious that numerous omissions, changes and additions may be made in such embodiments without departing from the spirit and scope of the invention.

What is claimed is:

1. Clamping means for cutting board assembly including a cutting board having a cutting edge and a knife mounted for shearing movement along said cutting edge; said clamping means comprising:

a clamp bar extending across said cutting board spaced from and substantially parallel to said cutting edge, said clamp bar having a flat bottom surface, means for moving said clamp bar between an elevated retracted position and a lowered clamping position, and including an upwardly-biased foot pedal, coupling means connecting said foot pedal to said clamp bar for movement of said clamp bar to said lowered clamping position when said foot pedal is depressed and movement of said clamp bar to said elevated retracted position when said foot pedal is released, and a stop member mounted above said foot pedal and having a portion overlying said foot pedal for limiting upward travel thereof and consequently establishing the retracted position of said clamp bar, an aligning strip secured to said clamp bar, and having opposed top and bottom surfaces and a portion projecting from said clamp bar toward said cutting edge, said projecting portion having a guide edge registering with the cutting edge of said cutting board, said aligning strip being secured to said clamp bar with its top surface flush against the flat bottom surface of said clamp bar, whereby the bottom surface of said aligning strip engages materials to be cut and clamps said materials against said cutting board when said clamp bar is brought to its clamping position.

2. Clamping means according to claim 1 in which said manually operable means also includes adjusting means for selectively adjusting the position of said stop member above said foot pedal.

3. Clamping means according to claim 2 in which said cutting board is mounted on legs supporting said cutting board above a support surface, and said foot pedal is mounted adjacent one of said legs, said stop member comprising a channel member mounted by said adjusting means on said one leg and having a portion overlying said foot pedal.

4. Clamping means according to claim 3 in which said adjusting means comprises a clamp bar and screw means connecting said clamp bar to said stop member with said one leg clamped therebetween, for releasably securing said stop member to said one leg in a selected position along the length of said leg.

5. Clamping means according to claim 1 in which said aligning strip is formed of transparent material.

6. Clamping means according to claim 1 in which said aligning strip is formed of opaque material and has a row of spaced notches along said guide edge.

7. Clamping means according to claim 6 in which said aligning strip is formed with a plurality of apertures in the body thereof behind said row of notches.

* * * * *